US009145738B2

(12) United States Patent
Mazarac

(10) Patent No.: US 9,145,738 B2
(45) Date of Patent: Sep. 29, 2015

(54) METHOD AND APPARATUS FOR FORMING A BOREHOLE

(76) Inventor: Kevin Mazarac, Houma, LA (US)

( * ) Notice: Subject to any disclaimer, the term of this patent is extended or adjusted under 35 U.S.C. 154(b) by 724 days.

(21) Appl. No.: 13/510,647

(22) PCT Filed: Nov. 20, 2009

(86) PCT No.: PCT/US2009/065332

§ 371 (c)(1),
(2), (4) Date: May 18, 2012

(87) PCT Pub. No.: WO2011/062588

PCT Pub. Date: May 26, 2011

(65) Prior Publication Data

US 2012/0228033 A1 Sep. 13, 2012

(51) Int. Cl.
*E21B 7/18* (2006.01)

(52) U.S. Cl.
CPC ..... *E21B 7/18* (2013.01)

(58) Field of Classification Search
CPC ..... E21B 7/046; E21B 7/24; E21B 7/18; E21B 10/61; E21B 2010/607
See application file for complete search history.

(56) References Cited

U.S. PATENT DOCUMENTS

| | | | | |
|---|---|---|---|---|
| 3,934,659 | A | 1/1976 | Tsiferov | |
| 4,175,626 | A * | 11/1979 | Tummel | 175/424 |
| 4,243,112 | A * | 1/1981 | Sartor | 175/55 |
| 4,673,312 | A | 6/1987 | Nussbaumer | |
| 6,263,984 | B1 | 7/2001 | Buckman, Sr. | |
| 6,530,439 | B2 | 3/2003 | Mazorow | |
| 2008/0110629 | A1 * | 5/2008 | Belew et al. | 166/298 |
| 2009/0101414 | A1 * | 4/2009 | Brunet et al. | 175/62 |

* cited by examiner

*Primary Examiner* — David Andrews
(74) *Attorney, Agent, or Firm* — McGarry Bair PC

(57) ABSTRACT

A jetting nozzle for forming boreholes or for cleaning out other tubular formations has a vibration-inducing mechanism that maximizing penetration rates and expands the diameter of the boreholes. The vibration-inducing mechanism can be an internal turbine responsive to the flow of pressurized jetting fluid through the nozzle. The nozzle has forward openings defining a voraxial spray pattern for the forward-directed jetting portion of the fluid exiting the nozzle. The nozzle can also have a pointed end that is adapted to penetrate the formation. The vibration also reduces friction between the fluid supply hose and the borehole being jetted through the formation by the nozzle. A system for forming boreholes with the jetting nozzle and a method of forming boreholes is also disclosed.

16 Claims, 7 Drawing Sheets

METHOD AND APPARATUS FOR FORMING A BOREHOLE

CROSS-REFERENCE TO RELATED APPLICATIONS

This application is a National Phase application of International Application No. PCT/US2009/065332, filed Nov. 20, 2009, which is incorporated herein by reference in its entirety.

FIELD OF THE INVENTION

The invention relates to drilling lateral boreholes from a main wellbore using a high pressure jetting hose for hydrocarbon recovery. In one of its aspects, the invention relates to a method of drilling lateral boreholes for hydrocarbon recovery from underground wells. In another of its aspects, the invention relates to an apparatus for drilling lateral boreholes for hydrocarbon recovery from underground wells. In another of its aspects, the invention relates to an nozzle for drilling lateral boreholes for hydrocarbon recovery from underground wells wherein the lateral boreholes are formed with diameters significantly greater than the diameter of the jetting nozzle that forms the lateral borehole.

DESCRIPTION OF RELATED ART

The creation of lateral (also known as "radial") boreholes in oil and gas wells using high pressure radial jetting was first introduced in the 1980's. Various tools have been used to create a lateral borehole in a hydrocarbon-producing reservoir formation for the purpose of extending the "reach" of the wellbore. Currently, the most accepted approach involves milling holes in the wellbore casing, and then subsequently using a tubing string to lower a high pressure jetting hose with a nozzle, sometimes referred to as a "jet-drilling nozzle" or a "jetting nozzle", on the leading end into the reservoir. The nozzle has openings in both a forward-facing direction and a rear-ward facing direction, wherein rearward-facing openings are configured to produce a forward thrust on the nozzle when jetting fluid is passed through the nozzle, thereby pulling the trailing hose behind it as the lateral borehole is created. The upper end of the more-flexible jetting hose is affixed to the lower end of the less-flexible tubing string. As a result control of the jetting nozzle lateral advancement into the reservoir strata is best when primarily or solely driven by the thrust of the jetting fluid through the nozzle.

Jetting nozzles are typically relatively small, for example on the order of less than 1-inch in length and less than ¾-inch in diameter, and are only able to generate a limited amount of thrust via the fluid exiting rearwardly from the nozzle (the "thrust portion" of the fluid). The jetting hose that the nozzle must pull through the reservoir strata can be hundreds of feet long. The hose is in frictional contact with the lateral jetted borehole and with various portions of the workstring in the main wellbore. These factors limit the distance that the nozzle is able to advance into the reservoir strata via nozzle-generated thrust.

Jetting nozzles depend solely on the jetting force of the fluid exiting forwardly through the nozzle (the "jetting portion" of the fluid) to penetrate the reservoir strata. The jetting force of forward-exiting fluid is therefore a penetration-limiting factor. Another penetration-limiting factor is that the jetting portion of the fluid exits forwardly from the nozzle in an essentially straight flow pattern, which is often not effective in penetrating many types of reservoir strata.

While jet-drilling nozzles used for lateral borehole formation in hydrocarbon wells are familiar to those in the oilfields, it is also known that pipelines, sewer lines, and other tubulars are sometimes cleaned out or washed using small diameter jet nozzles. As used herein, the term "tubulars" refers to any or all of the wellbore casing, the tubing and the pipeline.

SUMMARY OF THE INVENTION

According to the invention, a nozzle for use at the leading end of a fluid supply hose, wherein the nozzle is supplied with fluid from the hose to form a path through a material and to pull the hose forwardly through the path, comprises a housing with forward-facing jet openings and rearward-facing thrust openings, the housing defining a fluid flow path through the housing from the hose to the jet and thrust openings, and a vibration-inducing mechanism mounted in the housing in the fluid flow path, the vibration-inducing mechanism vibrating the housing radially in response to a flow of fluid through the fluid flow path.

In one embodiment, the vibration-inducing mechanism comprises a turbine rotatably mounted in the housing.

In another embodiment, the turbine can include a longitudinal axis, a turbine rotor; and a turbine body operatively connected to the turbine rotor and having mass distributed unequally about the longitudinal axis of the turbine. Further, the turbine body can be asymmetric and the turbine body can have an exterior flat surface.

In yet another embodiment, the turbine can include a longitudinal axis, a turbine rotor, a turbine body operatively connected to the rotor and a shiftable weight mounted in the turbine body, wherein the shiftable weight is mounted for movement relative to the turbine body as the turbine rotates. The turbine body can have a cavity, and the shiftable weight can be movably mounted in the cavity.

In another embodiment, the housing includes an exterior mechanical cutting surface. The exterior mechanical cutting surface can be formed on a portion of an exterior side surface of the nozzle that has a diameter at least as great as any other exterior surface of the nozzle. Preferably, the exterior of the nozzle is substantially cylindrical.

In another embodiment, a removable stop plate is formed in the housing between the hose and the turbine to mount the turbine in the housing and the stop plate forms a pathway therethrough in fluid communication with the turbine and the hose.

In still another embodiment, at least one of the forward-facing jet openings can be oriented voraxially relative to a center axis of the housing and can be adapted to create a voraxial flow pattern forward of the jet openings.

In yet another embodiment, a pointed tip can be formed on a forward end of the housing and can be adapted to penetrate a distal end of the borehole. The pointed tip is preferably generally conically-shaped.

Further according the invention, a nozzle for use at the leading end of a fluid supply hose, where the nozzle is supplied with fluid from the hose to form a path through a material and to pull the hose forwardly through the path, comprises a housing with forward-facing jet openings and rearward-facing thrust openings, the housing defining a fluid flow path through the housing from the hose to the jet and thrust openings, and a pointed tip on a forward end of the housing adapted to penetrate the material.

In a preferred embodiment, the pointed tip is generally conically-shaped.

Further according to the invention, an apparatus for drilling a borehole in a formation comprises a fluid supply hose and a nozzle connected to a leading end of the hose and supplied with fluid from the hose to form a borehole through the formation and to pull the hose forwardly through the path, wherein the nozzle comprises at least one of a vibration-inducing mechanism mounted in the housing and a pointed tip on a forward end of the housing as described above.

Further according to the invention, a method of drilling lateral boreholes in an underground formation, wherein lateral holes are formed in a wellbore casing and a lateral borehole is formed with a jetting nozzle attached to a hose that pumps fluid into the jetting nozzle, wherein the nozzle is vibrated radially while pumping a jetting fluid through a forward portion of the jetting nozzle.

In one embodiment, the method further includes forming a voraxial pattern forwardly of the jetting nozzle with the jetting fluid that is pumped through the forward portion of the jetting nozzle. The method can further comprise creating a forward thrust of the jetting nozzle by the fluid flow through the jetting nozzle.

In another embodiment, the method further comprises penetrating the formation at a distal end of the borehole with a leading tip of the nozzle to stabilize the nozzle with respect to the formation prior to vibrating the nozzle.

In still another embodiment, the method can further comprise cutting a distal end of the borehole with a leading tip of the nozzle.

These and other features and advantages will become apparent from the detailed description below, in light of the accompanying drawings.

DETAILED DESCRIPTION OF THE ILLUSTRATED EMBODIMENT

Figure 1:
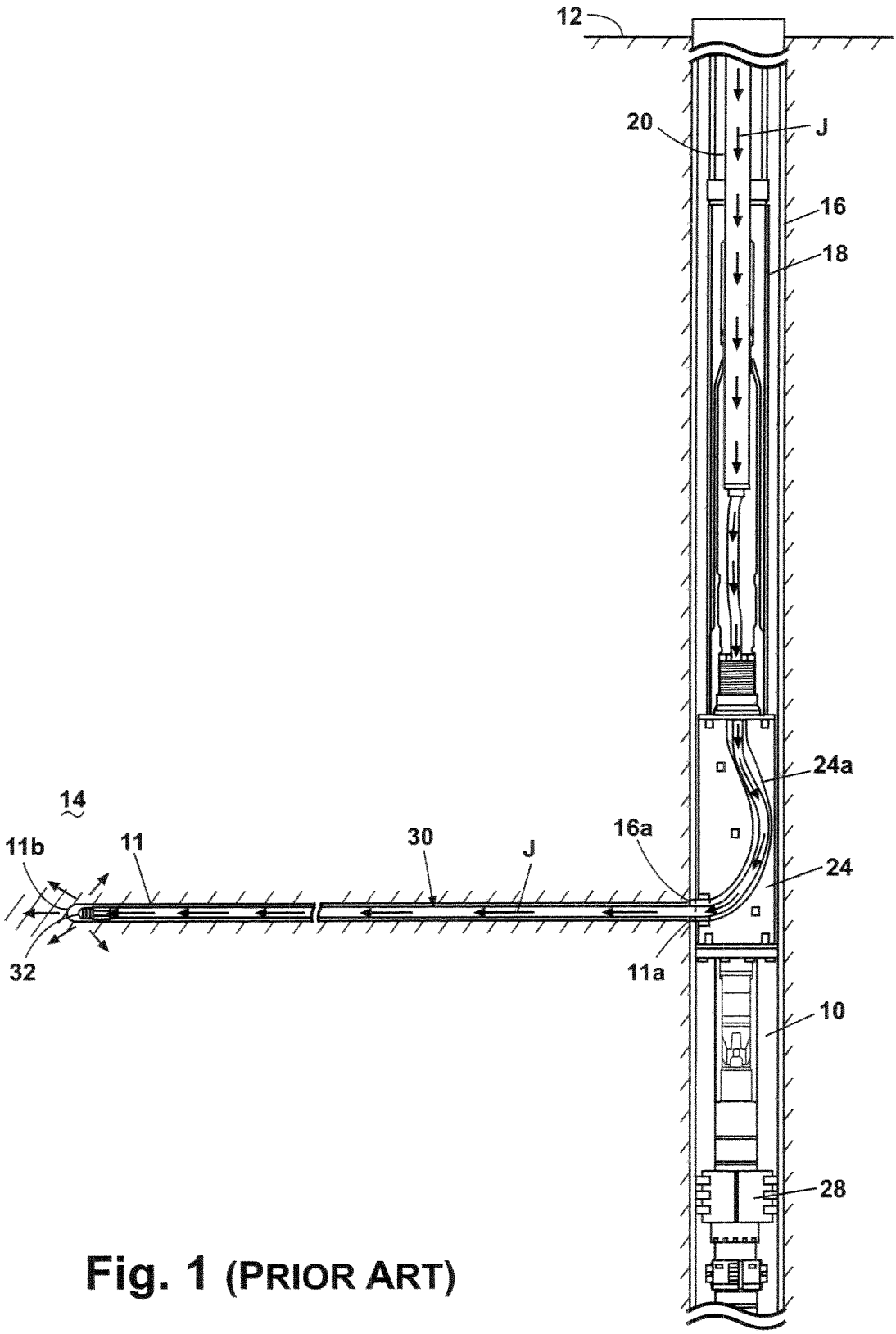
Fig. 1 (PRIOR ART)
FIG. 1 is a schematic view of a prior art hydrocarbon wellbore with a jetting hose and nozzle jetting a lateral borehole.

FIG. 1 shows a vertical wellbore 10 having a casing 16 and surrounded by a reservoir formation 14 having a surface 12 from which the vertical wellbore 10 can be accessed, and further shows a prior art assembly used for redirecting a jetting hose 30 out through an opening 16*a* previously formed in the casing 16 for the purpose of jetting a lateral borehole 11 in the reservoir formation 14 surrounding the wellbore 10. The lateral borehole 11 has a proximal end 11*a* adjacent to the opening 16*a* and defining an entrance into the borehole 11, and a distal end 11*b* opposite the proximal end 11*a* and defining the far end of the borehole 11 from the wellbore 10. The distance between the proximal end 11*a* and the distal end 11*b* defines the length of the borehole 11. When forming the borehole 11, the distal end 11*b* is constantly moved as the borehole 11 increases in length.

In general, the assembly includes a deflector 24 supported at or near the bottom of a workstring; for example, the deflector 24 can be secured to the end of a workstring tubing 18 as illustrated in FIG. 1. The vertical and rotational positioning of the deflector 24, and thus of the hose 30 as it is redirected laterally from the wellbore, may be determined by an indexer device (not shown) of known type. The assembly is locked in place as needed by an anchor 28.

A tubing string 20 is used to lower jetting hose 30 down the wellbore 10 and through the deflector 24 via channel 24*a* in communication with opening 16*a* to jet a lateral borehole 11 into the reservoir formation 14 in a known manner.

Standard tubing string 20 is illustrated as a string of "endless pipe", for example coiled tubing, which is commercially available in standard sizes from ½" to 2⅞" (inches) in diameter or more. The tubing string 20 is raised and lowered in the wellbore 10 using a standard tubing string unit (not shown) known to those skilled in the art located at the surface 12, the tubing string 20 being wrapped onto and off a reel at the surface 12 and being straightened as it goes through an injector head as it is forced into the wellbore 10. The tubing string 20 is typically made from various grades of steel; however, other materials such as titanium or composites can be used to construct the tubing. Alternatively, small diameter jointed tubing of known type can be substituted for standard tubing string 20.

Flexible jetting hose 30, often in a size of ½" to ¾" in diameter, is operatively connected to tubing string 20 to be lowered into and raised out of the wellbore 10 and to receive pressurized jetting fluid, indicated by arrows J, in known manner from the surface via the tubing string 20. The jetting hose 30 is capable of operating at a high fluid pressure, often 5,000 psi or more. Jetting hose 30 can be manufactured in different sizes larger than the standard small diameter size of ½"-¾" generally shown in the illustrated embodiment. Illustrated jetting hose 30 is flexible enough to be bent to turn through a 90-degree curve in a 2½" diameter, and has a pressure rating of 3,000 psi up to 10,000 psi. Jetting hose 30 is typically constructed of steel and elastomer or Kevlar.

The jetting hose 30 includes a jetting head or nozzle 32 on the distal end of the hose 30. Jetting nozzle 32 is of a type generally known in the art, with a generally cylindrical body containing one or more openings oriented in a forward direction for drilling purposes, and one or more openings oriented in a reverse or rearward direction for propulsion purposes. High pressure jetting fluid pumped through the tubing string 20 from the surface 12 accordingly enters the jetting nozzle 32 through hose 30, with a portion of the fluid exiting the forward end of the jetting nozzle 32 via the forward-facing holes, and the remaining fluid exiting the jetting nozzle 32 via the rearward-facing holes. The fluid exiting the forward-facing holes of nozzle 32 impacts the strata of reservoir formation 14, cutting a lateral borehole 11, i.e. drilling in the forward direction. The fluid exiting the jetting nozzle 32 from the rearward-facing holes has the effect of forcing the jetting nozzle 32 in the forward direction. The relative size of the forward and rearward openings in nozzle 32 causes a certain pressure drop based on the amount of fluid per unit time exiting the nozzle 32, and generates forward propulsion force as a result. As used herein, unless otherwise noted, the term "forward" refers to the end of a jetting nozzle toward, or in a direction toward, the terminal or distal end of the lateral borehole 11. The term "rearward" thus refers to an end of a jetting nozzle toward, or in a direction toward, the proximal end of the lateral borehole 11, i.e. the end of the borehole 11 that joins with the wellbore 10.

Figure 2:
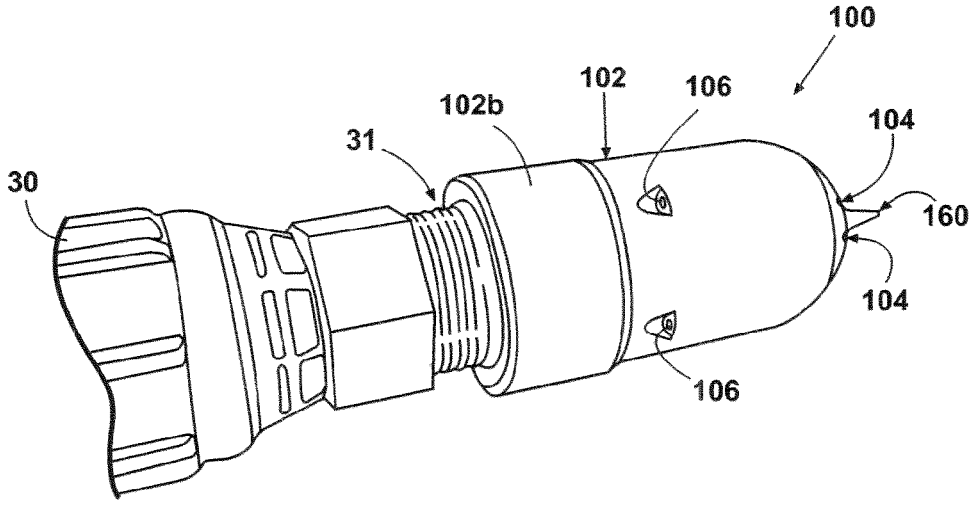
FIG. 2 is a rear perspective view of a nozzle according to the invention attached to a jetting hose.
Figure 2A:
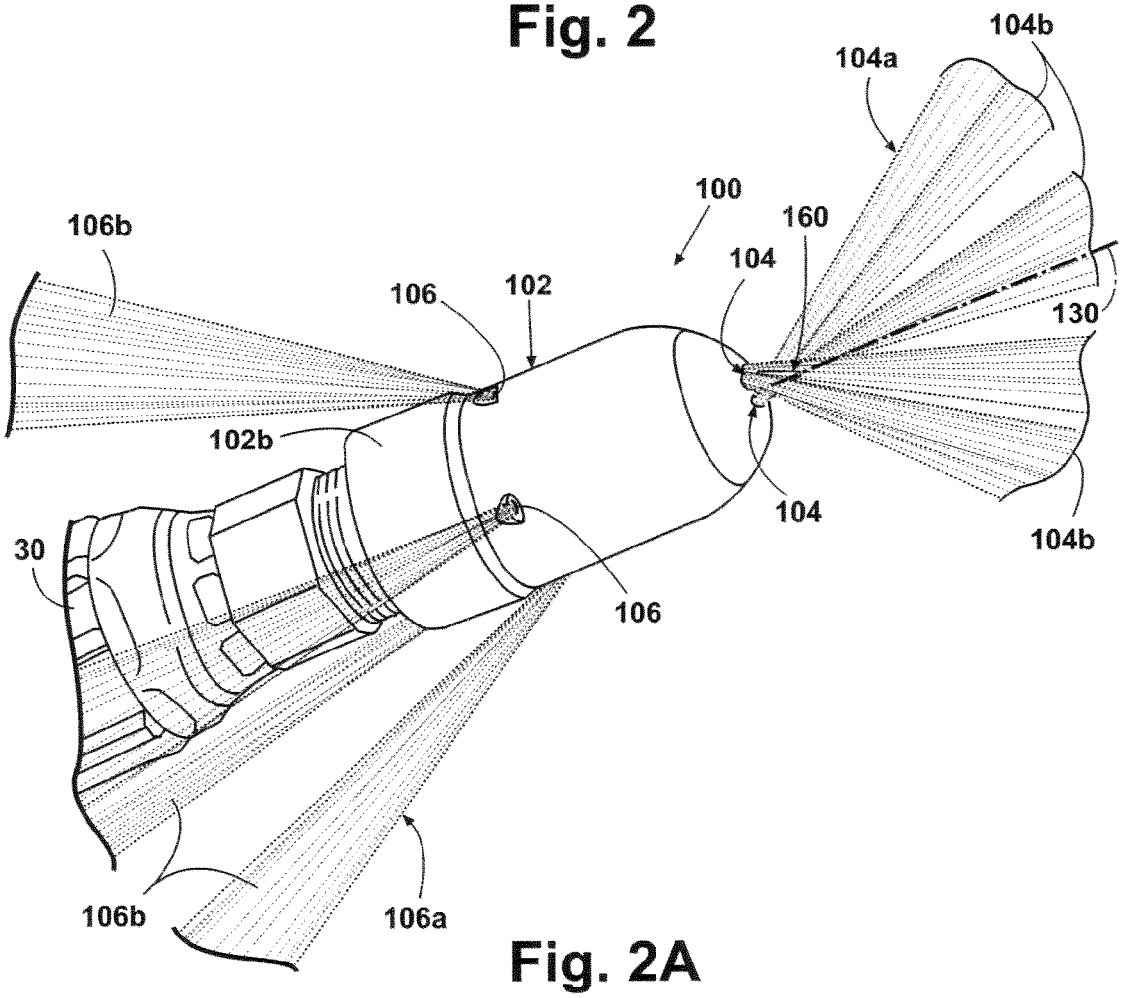
FIG. 2A is a front perspective view of FIG. 2, illustrating forward jetting and rearward thrust spray patterns from openings in the nozzle.

Referring to FIGS. 2 through 8, a jetting nozzle 100 according to the invention is illustrated. The jetting nozzle 100 can be used on hose 30 in a similar manner as described for FIG. 1, with some exceptions as noted below. The jetting nozzle 100 is shown in exemplary form in order to teach how to make and use the invention. Nozzle 100 includes a generally cylindrical housing 102 made from a durable, wear-resistant material such as (but not limited to) stainless steel, titanium, abrasion-resistant polymers, brass, or other ferrous or non-ferrous material. The rear end or base 102*b* of housing 102 is attached to jetting hose 30 with a high-pressure fluid-tight connection 31, which may be any type known to those skilled in the art. Nozzle housing 102 has forward-facing jet openings or holes 104 and rearward-facing jet openings or holes 106 in substantially even, balanced arrays around the periphery or circumference of the nozzle. The forward-facing and rearward-facing holes 104, 106 define outlets from a fluid flow path through the nozzle housing 102, the fluid flow path extending through the nozzle housing 102 from the hose 30 to the holes 104, 106. Any number of holes 104, 106 can be provided; in the illustrated embodiment, there are four evenly spaced forward-facing holes 104 and four evenly spaced rearward-facing holes 106, although only two of each type of hole 104, 106 are visible in FIG. 2. The housing 102 is hollow and receives fluid under pressure from hose 30, the fluid then being emitted from holes 104 and 106 as shown in FIG. 2A. Holes 104 and 106 are relatively small in diameter, often in the range of 0.015 to 0.030 inches in diameter, with the total area of the forward-facing holes 104 being less than the total area of the rearward-facing holes 106, resulting in a net force in the forward direction when fluid is applied.

FIG. 2A shows one exemplary, and in some cases preferred, spray pattern of fluid being emitted from nozzle 100. The spray pattern includes a forward or jetting portion 104*a*, which is created by fluid streams 104*b* emitted from the forward-facing holes 104, and a rearward or thrust portion 106*a*, which is created by fluid streams 106*b* emitted from the rearward-facing holes 106. The jetting portion 104*a* of the fluid spray pattern serves to break down or cut through the reservoir strata to form a lateral borehole, similar to the borehole 11 shown in FIG. 1; the thrust portion 106*a* of the fluid spray pattern serves to advance the nozzle 100 deeper into the strata of the reservoir formation, pulling hose 30 behind the nozzle 100 as the jetting portion 104*a* forms the lateral borehole. The number, angle, and placement of the holes 104 and 106 in nozzle 100 can vary as long as the forward-facing holes 104 serve to form a borehole through the strata of the reservoir formation and the rearward-facing holes 106 serve to thrust the nozzle 100 (thus pulling the hose 30) forward into the borehole.

The jetting portion 104*a* shown in FIG. 2A forms a vortex-like pattern around a center axis 130 of nozzle 100 that will be referred to herein as a "voraxial" pattern. In general, a voraxial pattern is vortex-like, and resembles a tornado in that it includes a three dimensional swirling or whirling motion around a center point or center line and the pressure in the center of the pattern is lower than the ambient pressure. If the fluid portion of the voraxial pattern were represented with a vector, the vector would be perpendicular to a radial direction at any given time.

The voraxial pattern of the jetting portion 104*a* is vortex-like in that the individual streams 104*b* through each forward-facing opening 104 are angled inwardly toward the center longitudinal axis 130 of nozzle 100, without crossing or interfering with the other streams 104*b*, as they exit their respective holes 104. At least one of the forward-facing openings 104 can be oriented voraxially relative to the longitudinal axis 130 of nozzle 100 to achieve the corresponding voraxial pattern. It should be noted that while the streams 104*b* do not cross each other as they exit the forward-facing holes 104, there may be some crossing of streams 104*b* farther out from the nozzle 100 since the diameter of the streams 104*b* generally increase in correlation to the distance from the hole 104.

The housing 120 has a leading tip 160 at the distal or forward end of the housing. The leading tip 160 can be adjacent to the forward-facing holes 104; in the illustrated embodiment, the leading tip 160 is positioned centrally between the four holes 104. The leading tip 160 is pointed at the end, and can be conically-shaped, with the base of the cone attached to the housing, and the point of the cone is free. In operation, the leading tip 160 digs or cuts into the reservoir formation, and acts to break down the strata of the formation at the distal end of the lateral borehole. Further, after to exiting the deflector shoe but prior to the fluid flow through the nozzle 100, the leading tip 160 will initially penetrate the strata to stabilize the nozzle 100. Thereafter, fluid flow through the hose 30 is commenced and the nozzle 100 will begin jetting a lateral borehole. The initial penetration of the pointed tip 160 into the formation prior to the jetting action is an important step in the start of the lateral borehole formation in that it stabilizes the nozzle with respect to the formation to begin the lateral bore hole in a controlled radial direction from the well bore.

Figure 3:
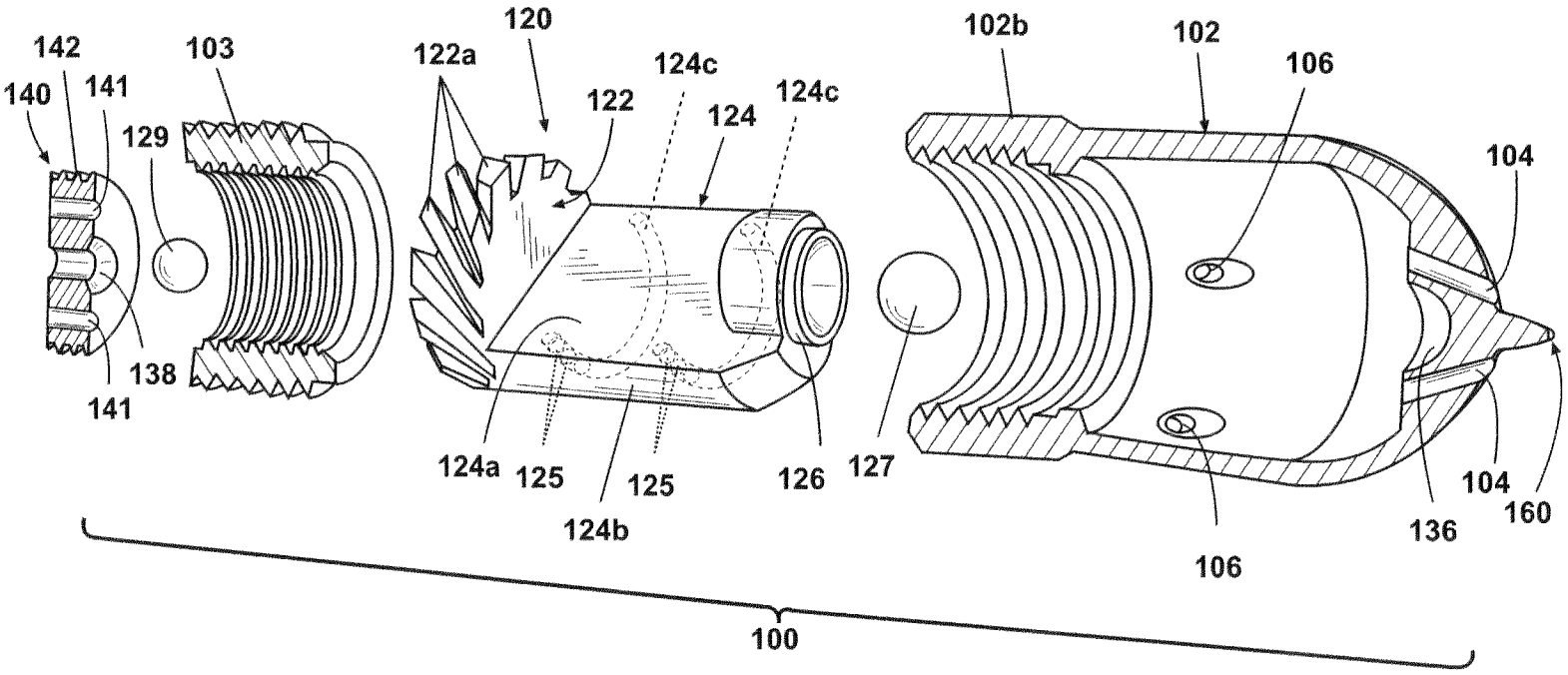
FIG. 3 is an exploded front-end perspective view of the nozzle of FIG. 2, including an unbalanced turbine in a nozzle housing, with portions of the nozzle shown in section.

FIG. 3 is an exploded view of the nozzle 100, with portions of the nozzle shown in section to illustrate the interior of nozzle 100. The nozzle 100 has a vibration-inducing mechanism mounted within the housing 102 in the fluid flow path. The vibration-inducing mechanism is adapted to vibrate the housing 102 radially in response to a flow of fluid in the fluid flow path. The vibration moves the nozzle 100 radially within the lateral borehole in multiple directions to impart a radial mechanical cutting action, as will be described below, against the reservoir strata to increases the diameter of the lateral borehole and thereby lowers the friction on the hose 30 trailing from the nozzle 100.

Figure 5:
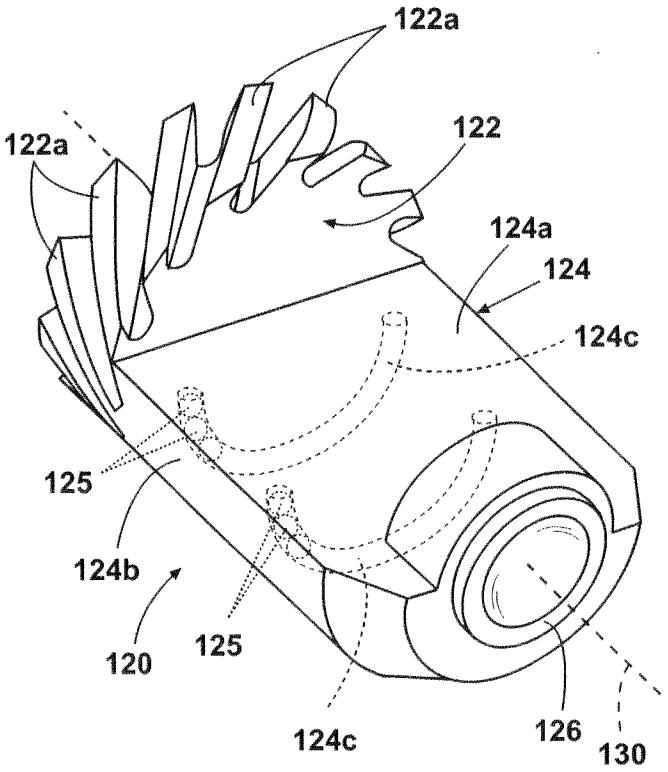
FIGS. 4 and 5 are rear-end and front-end perspective views, respectively, of the turbine of FIG. 3 in different rotational positions.
Figure 4:
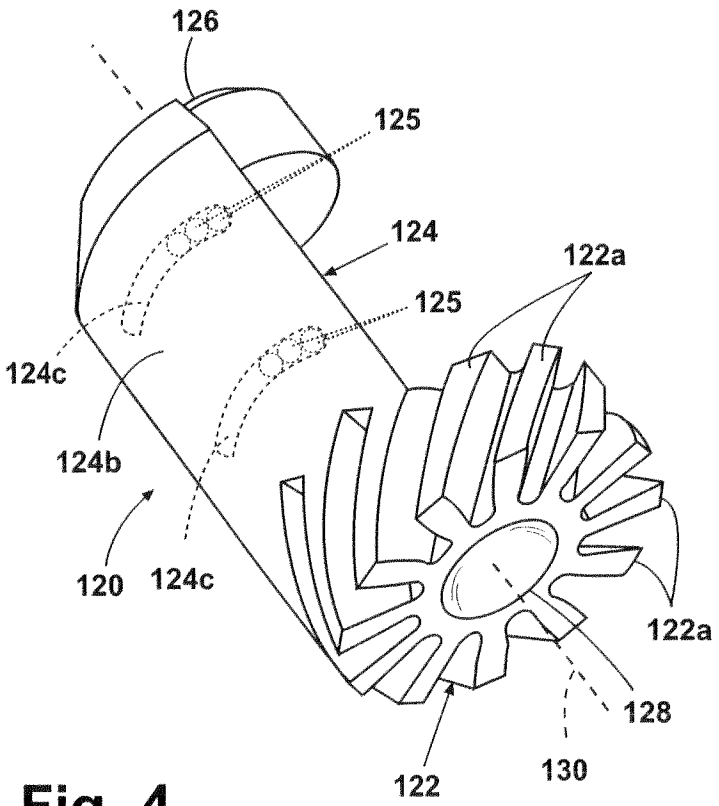
Figure 6:
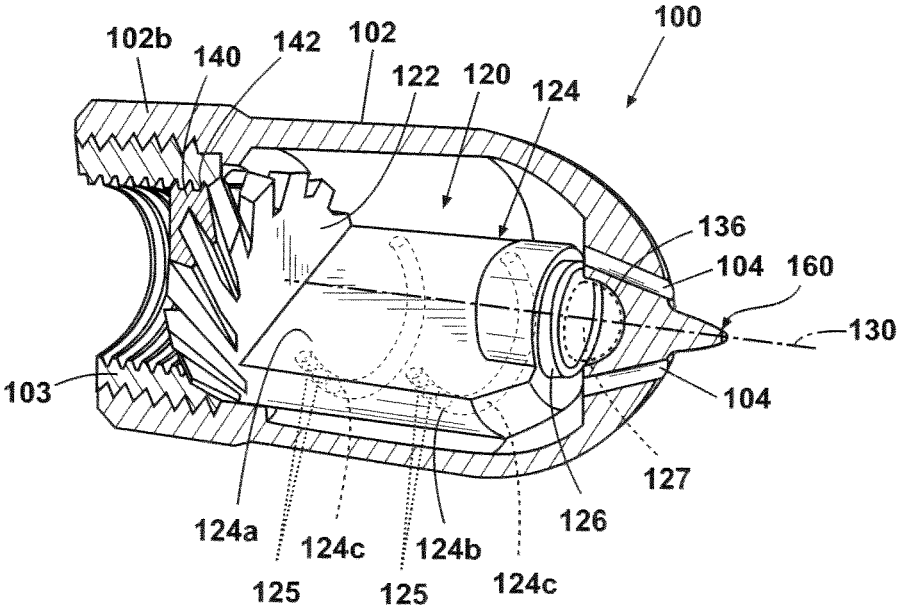
FIG. 6 is a perspective front view of the assembled nozzle of FIG. 2, with the housing partially cut away.

In the illustrated embodiment, the vibration-inducing mechanism is a turbine 120 mounted within the housing 102 for rotation about axis 130 (FIG. 2A). FIGS. 4 and 5 show turbine 120 removed from the nozzle interior. Turbine 120 can be formed of and suit material including stainless steel, for example, but the same variety of materials suitable for housing 102 is suitable for the manufacture of turbine 120. Turbine 120 has an integral rotor 122 with a plurality blades 122*a* formed, for example, by machining, into rotor 122. The blades 122*a* impart a rotational force on the rotor 120 to rotate about axis 130 relative to housing 102 as jetting fluid enters the base 102*b* of the housing 102 and flows forward through the blades 122*a*. The angle and spacing of blades 122*a* are chosen to rotate the turbine 120 to produce a suitable vibration rate to increase the size of the borehole and to enhance the penetration of the nozzle into the distal end of the borehole. The flow rate of the jetting fluid can be adjusted to produce the desired vibration which can vary depending on the nature of the formation. Therefore, the flow rate of the jetting fluid can vary over a wide range but will generally be in the range of 1 to 12 gallons per minute, preferably 2 to 8 gallons per minute, although these flow rates can be varied according to the nature of the jetting operation. At these ranges of gallons per minute, the speed of the turbine will range from 12,000 to 18,000 rpm.

Depending on the flow rates of the fluid, the turbine rates can range from 1,000 up to 50,000 rpm. The turbine rates affect the vibration rates, which in turn are tailored to the type of rock or formation in which the bore hole is formed.

While rotor 122 is shown as an integrally-formed part of turbine 120, the various portions of turbine 120, such as the rotor and/or blades, can be formed of multiple parts operatively connected to one another, and formed of the same or from different materials.

The angle and spacing of blades 122*a* is also preferably chosen to impart a swirling action to the flow of jetting fluid passing through the rotor 122, complementing and ideally increasing the voraxial effect imparted to the fluid exiting forward-facing holes 104, thereby strengthening the voraxial pattern. Since pressure in the center of the voraxial pattern is lower than the ambient pressure, a vacuum effect is created, thereby pulling the jetting nozzle 100 forwardly.

Turbine 120 has a forward end bearing profile 126 and rear end bearing profile 128, that each mount or receive a ball bearing 127 and 129, respectively. Ball bearings 127 and 129 in turn are respectively mounted or bear against a forward bearing profile 136 formed in an inner surface of housing 102 near its forward end, and against a rear bearing profile 138 formed in an adjustable stop plate 140 located rearwardly of the turbine 120. The bearing profiles 126, 128, 136, 138 each have a concave or semi-hemispherical shape, and can be slightly larger than the ball bearings 127, 129 received therein. Thus, the ball bearings 127, 129 mount the turbine 120 for rotation about the axis.130 within housing 102.

Stop plate 140, best shown in FIG. 3, is adjustably secured in internal threaded portion 103 of housing base 102*b* through external threads 142, and secures turbine 120 and the bearings 127, 129 longitudinally in the housing 102 for free rotation about axis 130. Stop plate 140 includes orifices 141 spaced around the central bearing profile 138 to admit pressurized jetting fluid from hose 30, which then flows through rotor blades 122*a* to rotate turbine 120. Stop plate 140 is preferably formed from stainless steel, but other materials, such as those suitable for turbine 120 and housing 102, can also be used. In an alternate embodiment, not illustrated, the stop plate 140 can be integrally formed in one piece with the internal threaded portion 103. In another alternate embodiment, not illustrated, the internal threaded portion 103 can be eliminated, and the stop plate 140 can be integrally formed with the housing base 102*b*.

Stop plate 140 can be rotatably adjusted to different longitudinal positions relative to housing 102 to provide the desired bearing force on turbine 120 and on its bearings 127, 129 inside the nozzle 100. Stop plate 140 is also easily removed by simply unscrewing the stop plate 140 from the internal threaded portion 103, to open the interior of the housing 102 for cleaning and inspection, and further for ease of replacement of the turbine 120 and/or bearings 127 and 129.

Ball bearings 127 and 129 can be made from stainless steel, but other materials including, but not limited to, carbon fiber, polymer, ferrous steel, and bronze can also be used. Furthermore, the nozzle 100 is not limited using ball bearings, or to using bearings separate from the turbine 120, housing 102, or stop plate 140. The turbine can be rotatably mounted to the housing 102 through other commonly known mechanical elements such as annular bearings.

Referring to FIGS. 4 and 5, turbine 120 has a body 124 forwardly of rotor 122, the body 124 making up a significant portion, and preferably a majority, of the mass of the turbine 120. Body 124 is designed to impart radial vibration to the nozzle 100 (i.e. generally perpendicular to the axis 130) when turbine 120 rotates by making the body 124 unbalanced relative to the axis 130, and/or by placing vibration-inducing or vibration-enhancing members in body 124 that shift radially as the turbine 120 rotates. As illustrated, body 124 is both unbalanced and provided with vibration-inducing or vibration-enhancing members in the form of shifting weights.

Referring to FIGS. 3 through 6, the body 124 is unbalanced by forming the body 124 as non-symmetrical. This configuration will unbalance the mass of the body 124 relative to axis 130. As illustrated, the body 124 is shaped, for example, by machining a cylinder to remove a partial circumferential portion thereof, leaving it substantially in the form of a semi-cylinder with a flat inner face 124*a* adjacent the axis 130, and a semi-cylindrical outer face 124*b* that is adjacent the inner surface of housing 102 when the nozzle 100 is assembled. Other methods of unbalancing the mass of body 124 relative to the axis 130 are possible, with the illustrated semi-cylinder being one effective design for inducing vibration in the nozzle 100. The body 124 could, for example and without limitation, be made cylindrical or symmetrical, but of one or more material(s) having a density or densities unevenly distributed around axis 130.

As illustrated, the body 124 is additionally provided with one or more shiftable weighted members 125 that will induce or enhance vibration of the nozzle 100. The weighted members 125 are mounted loosely in pockets or internal cavities 124*c* on or in the body 124, the cavities 124*c* arranged so that rotation of turbine 120 about axis 130 causes the weighted members 125 to rattle, roll, or otherwise shift in cavities 124*c*. The impact of the weight members 125 striking the surfaces of the cavities 124*c* and each other will induce or enhance the vibration of the nozzle 100. In the illustrated embodiment, weighted members 125 are small balls made from lead, although other shapes and other materials of greater or lesser density could be used. In general, however, the greater the density of the weighted members 125, the greater the impact caused thereby, which in turn increases the magnitude of vibration.

While a combination of an unsymmetrical body 124 and shiftable weights has been illustrated, it will be understood that the shiftable weights could be used in a symmetrical turbine body for a similar vibration-inducing effect. Furthermore, other arrangements for unbalancing the turbine body 124 could be used in place of shiftable weights. For example, instead of forming internal cavities 124*c* in the body 124 which receive weighted members 125, a large recess can be provided in the flat inner face 124*a* of the body 124 in the form of a boat-like shape. The recess or hollow will suitably unbalance the body 124 to achieve the desired vibration-inducing effect.

Figure 7:
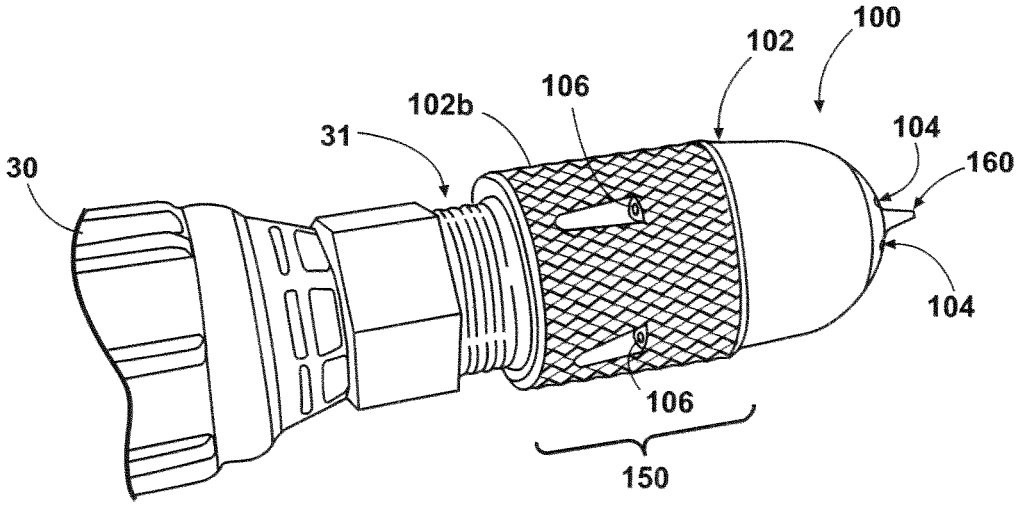
FIG. 7 is a perspective view of the nozzle of FIG. 2, illustrating an exterior cutting surface formed on a side surface of the housing.

FIG. 7 illustrates an embodiment of the exterior of nozzle housing 102 having at least one cutting surface 150 on the exterior of the housing 102. The cutting surface 150 provides an enhanced contact area that aids in efficient borehole formation. The cutting surface 150 can be formed at the widest portion of or the largest-diameter surface of the housing 102, since that portion of the housing 102 is most likely to contact the lateral borehole being jetted as the nozzle 100 advances through the reservoir formation—especially as the nozzle 100 is vibrated against the sides of the borehole by turbine 120. The cutting surface 150 can be enhanced by providing a roughened or textured outer surface, or by forming projections extending form the outer surface. The area 150 can be formed using different processes, such as the illustrated knurling, checkering, peening, by applying a finish or surface treatment such as carbide, diamond, or other hardened finishes, or by machining teeth, knobs, or other small projections into the exterior surface of the housing 102.

Figure 8:
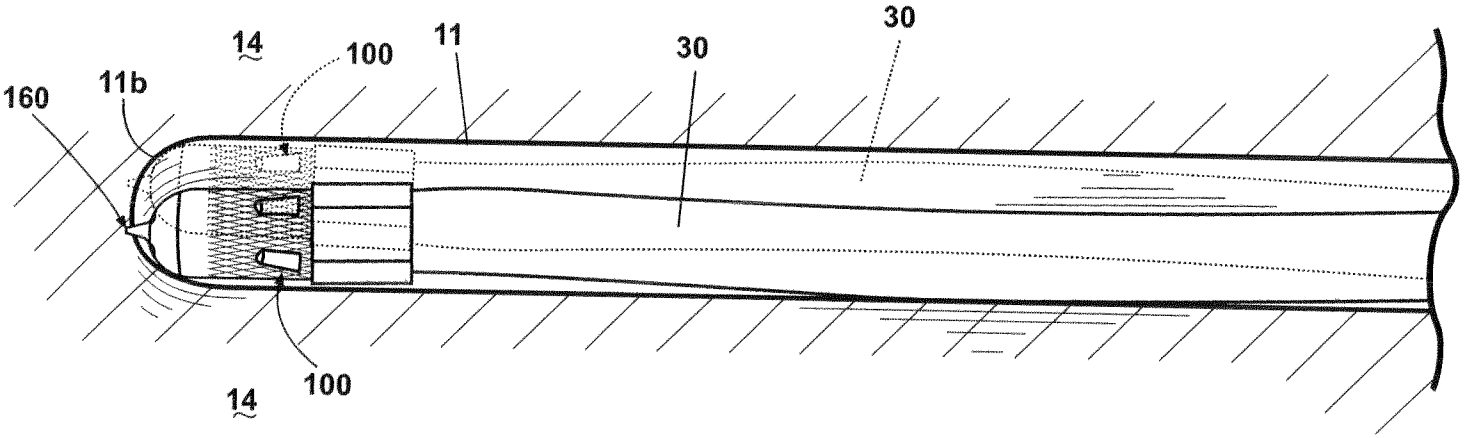
FIG. 8 is a schematic view of the jetting hose and nozzle of FIG. 2 jetting a lateral borehole, with vibration of the nozzle and the hose shown schematically.

FIG. 8 is a schematic illustration of the nozzle 100 jetting a lateral borehole 11 in a reservoir formation 14. The nozzle 100 is coupled to the hose 30, and while the assembly used to direct the hose 30 and nozzle 100 down a wellbore and the wellbore itself is not shown in the drawing, both can be assumed to be similar to assembly and wellbore 10 shown in FIG. 1. As indicated by the phantom line nozzle 100 and hose 30, during jetting, the nozzle 100 vibrates against the sides and forward end of lateral borehole 11, increasing the cutting or penetrating action of the forward spray of jetting fluid from the front end of the nozzle 100. The leading tip 160 penetrates the distal end 11*b* of the lateral borehole to initially stabilize the nozzle 110 and then digs or cuts into the reservoir formation to help break down the strata of the formation. Forward thrust for the nozzle 100 can be created by a combination of the rearward spray of jetting fluid from the rear end of the nozzle 100 and the vacuum formed in front of the nozzle 100 by the voraxial pattern of the forward spray. While the spray pattern of fluid being emitted from the nozzle 100 is not shown in FIG. 8 in the interests of clearly showing the vibration of the nozzle 100, the spray pattern is shown in FIG. 2A. Also shown schematically is the vibration imparted to hose 30 as the hose 30 is pulled behind nozzle 100 through the lateral borehole 11. Hose vibration has been found to reduce the friction of the hose 30 relative to borehole 11, further increasing the ability of nozzle 100 to advance into the reservoir formation 14.

Finally, while the foregoing examples in FIGS. 2-8 have been discussed in the context of a nozzle 100 used for jetting a lateral borehole through a hydrocarbon-producing formation 14, nozzle 100 is believed to be useful for other types of bore-forming operations, or for tubular-cleaning or unblocking operations, including, but not limited to, cleaning out sewer lines, washing out or clearing blockages from pipes, and washing sand and debris out of wellbore casings and tubing. The size of nozzle 100 and hose 30, the forward and rearward jetting and thrusting spray patterns of nozzle 100, the degree of vibration induced by internal turbine 120, the materials and surface treatments used for nozzle housing 102, and other aspects of nozzle 100 can accordingly be modified for such other uses. Reference herein to nozzle 100 as a "jetting" nozzle is accordingly not intended to limit the claimed subject matter to use in drilling boreholes in a hydrocarbon-producing formation.

It will be understood that the disclosed embodiments are representative of presently preferred examples of how to make and use the claimed invention, but are intended to be explanatory rather than limiting of the scope of the invention as defined by the claims below. Reasonable variations and modifications of the illustrated examples in the foregoing written specification and drawings are possible without departing from the scope of the invention as defined in the claims below. It should further be understood that to the extent the term "invention" is used in the written specification, it is not to be construed as a limiting term as to number of claimed or disclosed inventions or the scope of any such invention, but as a term which has long been conveniently and widely used to describe new and useful improvements in technology. The scope of the invention is accordingly defined by the following claims.

What is claimed:

1. A nozzle for use at the leading end of a fluid supply hose, wherein the nozzle is supplied with fluid from the fluid supply hose to form a path through a material, the nozzle comprising:

a housing comprising multiple forward-facing jet openings, the housing defining a fluid flow path from the hose to the jet openings; and a vibration-inducing mechanism mounted within the housing in the fluid flow path and configured for vibrating the housing radially in response to a flow of fluid in the fluid flow path;

wherein the vibration-inducing mechanism comprises a turbine rotatably mounted in the housing, and wherein the turbine comprises:

a longitudinal axis;

a turbine rotor;

a turbine body operatively connected to the rotor; and a shiftable weight mounted in the turbine body, wherein the shiftable weight is mounted for movement relative to the turbine body as the turbine rotates.

2. The nozzle of claim 1, wherein the shiftable weight has mass distributed unequally about the longitudinal axis of the turbine.

3. The nozzle of claim 1, wherein the turbine body is asymmetric.

4. The nozzle of claim 1, wherein the turbine body has an exterior flat surface.

5. The nozzle of claim 1, wherein the turbine body comprises a cavity, and the shiftable weight is movably mounted in the cavity.

6. The nozzle of claim 1, wherein the housing comprises an exterior mechanical cutting surface.

7. The nozzle of claim 6, wherein the exterior mechanical cutting surface is formed on a portion of an exterior side surface of the nozzle that has a diameter at least as great as any other exterior surface of the nozzle.

8. The nozzle of claim 7, wherein the exterior of the nozzle is substantially cylindrical.

9. The nozzle of claim 1, and further comprising a removable stop plate in the housing between the hose and the turbine and mounting the turbine in the housing, the stop plate comprising a pathway therethrough in fluid communication with the turbine and the hose.

10. The nozzle of claim 1, wherein at least one of the forward-facing jet openings is oriented voraxially relative to a center axis of the housing and is adapted to create a voraxial flow pattern forward of the jet openings.

11. The nozzle of claim 10 and further comprising a pointed tip on a forward end of the housing adapted to penetrate the distal end of the borehole.

12. The nozzle of claim 11, wherein the pointed tip is generally conically-shaped.

13. The nozzle of claim 1 and further comprising a pointed tip on a forward end of the housing configured to penetrate the distal end of the borehole.

14. The nozzle of claim 13, wherein the pointed tip is generally conically-shaped.

15. The nozzle of claim 1 wherein the housing further comprises multiple rearward-facing thrust openings defining a fluid flow path from the hose to the thrust openings to pull the hose forwardly through the path.

16. An apparatus for drilling a borehole in a formation, the apparatus comprising:

a fluid supply hose; and the nozzle of claim 1 connected to a leading end of the hose and supplied with fluid from the hose to form a borehole through the formation and, optionally, to pull the hose forwardly through the path.

* * * * *